US010526869B2

(12) United States Patent
Mebratu et al.

(10) Patent No.: US 10,526,869 B2
(45) Date of Patent: Jan. 7, 2020

(54) DOWNHOLE SCALE REMEDIATION ABOVE A DOWNHOLE SAFETY VALVE

(71) Applicant: Halliburton Energy Services, Inc., Houston, TX (US)

(72) Inventors: Amare Ambaye Mebratu, Stavanger (NO); Yogesh Kumar Choudhary, Stavanger (NO)

(73) Assignee: Halliburton Energy Services, Inc., Houston, TX (US)

( * ) Notice: Subject to any disclaimer, the term of this patent is extended or adjusted under 35 U.S.C. 154(b) by 84 days.

(21) Appl. No.: 15/768,512

(22) PCT Filed: Feb. 26, 2016

(86) PCT No.: PCT/US2016/019761

§ 371 (c)(1),
(2) Date: Apr. 13, 2018

(87) PCT Pub. No.: WO2017/146725

PCT Pub. Date: Aug. 31, 2017

(65) Prior Publication Data

US 2018/0298721 A1 Oct. 18, 2018

(51) Int. Cl.

| | |
|---|---|
| ***E21B 37/06*** | (2006.01) |
| ***E21B 34/06*** | (2006.01) |
| *E21B 34/00* | (2006.01) |

(52) U.S. Cl.

CPC ..... *E21B 34/06* (2013.01); *E21B 37/06* (2013.01); *E21B 2034/005* (2013.01)

(58) Field of Classification Search

CPC ..... E21B 34/06; E21B 37/06; E21B 2034/005
See application file for complete search history.

(56) References Cited

U.S. PATENT DOCUMENTS

| | | | |
|---|---|---|---|
| 7,198,099 | B2 | 4/2007 | Lugtmeier et al. |
| 2010/0230109 | A1 | 9/2010 | Lake et al. |
| 2011/0272160 | A1 | 11/2011 | Arvie, Jr. et al. |
| 2012/0097392 | A1 | 4/2012 | Reyes et al. |
| 2014/0329726 | A1 | 11/2014 | Ezell et al. |
| 2015/0000912 | A1 | 1/2015 | Choudhary et al. |

FOREIGN PATENT DOCUMENTS

WO WO-2013/028343 A1 2/2013

OTHER PUBLICATIONS

International Search Report and Written Opinion from PCT/US2016/019761, dated Oct. 12, 2016, 10 pages.

*Primary Examiner* — David J Bagnell
*Assistant Examiner* — Yanick A Akaragwe
(74) *Attorney, Agent, or Firm* — Thomas Rooney; C. Tumey Law Group PLLC

(57) ABSTRACT

Scale remediation at or around a downhole safety valve (DSV), including the volume of a wellbore in a subterranean formation above the DSV. Wellbore fluid is displaced using a gas, the DSV is closed, the gas is released, and a treatment fluid comprises a base fluid and a scale-removal agent is allowed to react with scale in the volume of the wellbore above the DSV.

20 Claims, 8 Drawing Sheets

DOWNHOLE SCALE REMEDIATION ABOVE A DOWNHOLE SAFETY VALVE

BACKGROUND

The present disclosure relates generally to subterranean formation operations and, more particularly, to scale remediation in a subterranean formation wellbore above a downhole safety valve.

Downhole safety valves (DSV) are installed in wellbores (which may be used interchangeably with simply "well" herein) to isolate wellbore pressure and fluids in the event of an emergency or catastrophic failure of wellbore equipment (e.g., downhole or surface equipment). The DSV thus functions as a failsafe to prevent the uncontrolled release of fluids from a wellbore, including fluids originating from the wellbore and those introduced there (e.g., treatment fluids). Certain local governments require a DSV, or require the failsafe mechanisms to prevent the uncontrolled release of fluids from a wellbore (which a DSV is designed to achieve). For example, regulations for wellbores in the North Sea require a DSV and if the functionality of the DSV is lost, the wellbore must be taken off of production. The DSV is typically installed as part of a completion design and is tubing retrievable, such as in the event of a malfunction of the DSV. Accordingly, the DSV can be retrieved to the surface and its function resolved during a workover (including replacement of the DSV entirely), which is often costly in terms of time and monetary price.

Throughout the production of a wellbore, scale can build up on the inner surfaces of completion equipment, including the DSV and surrounding area, as well as wellbore surfaces. Scale is a deposit or coating formed on the surface of a metal, rock, or other material. The buildup of scale on and around a DSV can render the DSV either more difficult to operate or completely inoperable. For example, the DSV can be scaled such that the flapper valve is unable to fully close in the event of an emergency, or the area surrounding the DSV can be scaled such that the operability (e.g., opening or closing) of the DSV is compromised. Accordingly, if scale is not inhibited or removed during the lifetime of a wellbore from a DSV (which buildup has occurred), the functionality of the DSV is compromised and a costly workover may be required.

BRIEF DESCRIPTION OF THE DRAWINGS

The following figure is included to illustrate certain aspects of the examples and embodiments described herein, and should not be viewed as exclusive. The subject matter disclosed is capable of considerable modifications, alterations, combinations, and equivalents in form and function, as will occur to those skilled in the art and having the benefit of this disclosure.

DETAILED DESCRIPTION

Figure 1:
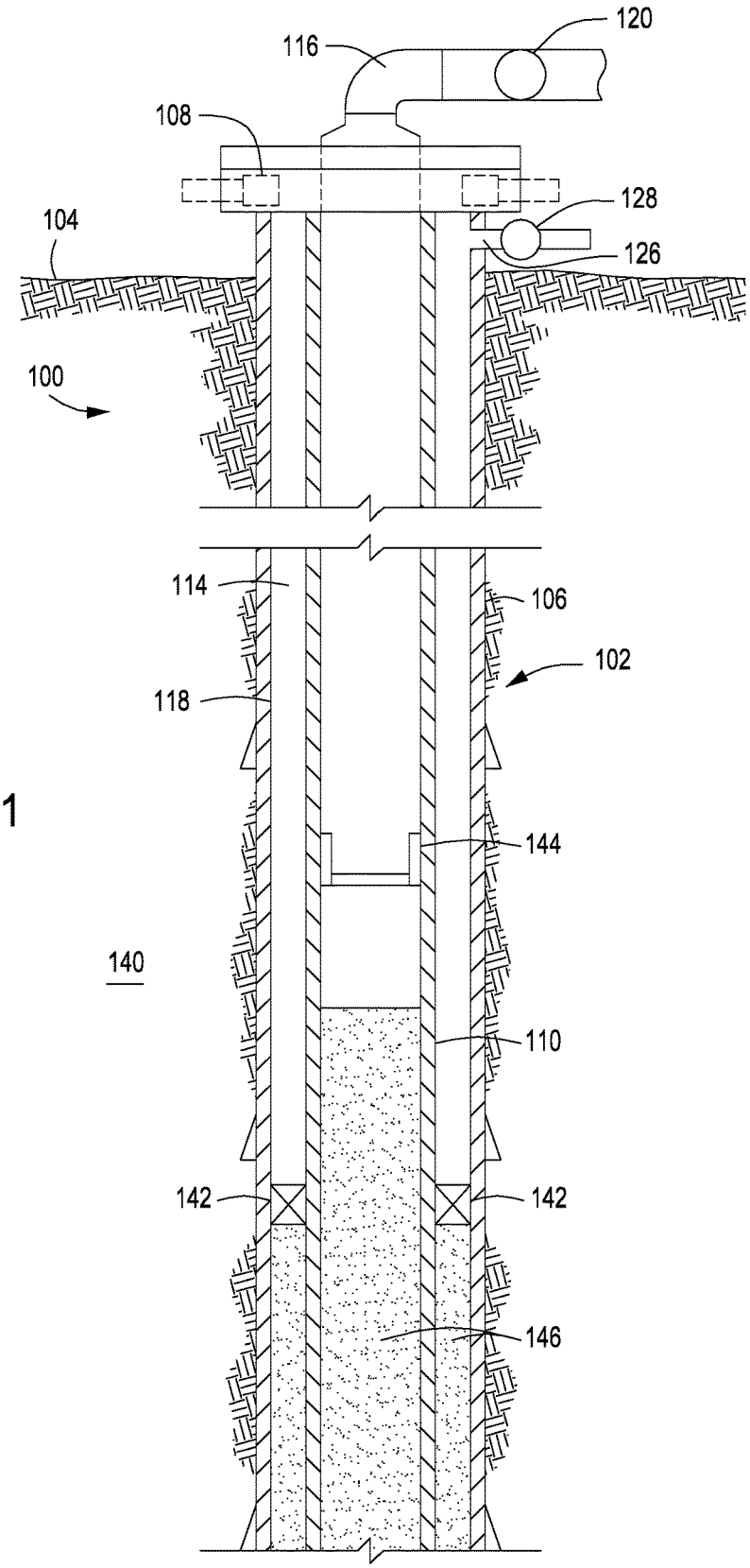
FIGS. 1-5 are a series of cross-sectional illustrations of a wellbore system being treated for scale remediation at and above a DSV.

The present disclosure relates generally to subterranean formation operations and, more particularly, to scale remediation in a subterranean formation wellbore above a DSV. More particularly, the present disclosure describes removing or reducing scale buildup on and around a DSV, and specifically from the wellbore portion above the DSV. The examples and embodiments of the present disclosure allow scale remediation of the volume of the wellbore above the DSV in a controlled manner, without having to resort to mechanical intervention, and can be employed in low pressure wellbores with increased success rate for removing both organic and inorganic scale.

Not all features of an actual implementation are described or shown in this application for the sake of clarity. It is understood that numerous implementation-specific decisions may need to be made to achieve the developer's goals, such as compliance with system-related, lithology-related, business-related, government-related, and other constraints, which vary by implementation and from time to time. While a developer's efforts might be complex and time-consuming, such efforts would be, nevertheless, a routine undertaking for those of ordinary skill in the art having benefit of this disclosure.

It should be noted that when "about" is provided herein at the beginning of a numerical list, the term modifies each number of the numerical list. In some numerical listings of ranges, some lower limits listed may be greater than some upper limits listed. One skilled in the art will recognize that the selected subset will require the selection of an upper limit in excess of the selected lower limit. Unless otherwise indicated, all numbers expressing quantities of ingredients, properties such as molecular weight, reaction conditions, and so forth used in the present specification and associated claims are to be understood as being modified in all instances by the term "about."

Values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "about 0.1% to about 5%" or "about 0.1% to 5%" should be interpreted to include not just about 0.1% to about 5%, but also the individual values (e.g., 1%, 2%, 3%, and 4%) and the sub-ranges (e.g., 0.1% to 0.5%, 1.1% to 2.2%, 3.3% to 4.4%) within the indicated range. The statement "about X to Y" has the same meaning as "about X to about Y," unless indicated otherwise. Likewise, the statement "about X, Y, or about Z" has the same meaning as "about X, about Y, or about Z," unless indicated otherwise.

The term "about" refers to a +/−5% numerical value. For example, if the numerical value is "about 5," included is an upper limit of 5.25 to a lower limit of 4.75, encompassing any value and subset therebetween. Accordingly, unless indicated to the contrary, the numerical parameters set forth in the following specification and attached claims are approximations that may vary depending upon the desired properties sought to be obtained based on the present disclosure. At the very least, and not as an attempt to limit the application of the doctrine of equivalents to the scope of the claim, each numerical parameter should at least be construed in light of the number of reported significant digits and by applying ordinary rounding techniques.

It should further be noted that, as used herein, the term "substantially" means largely, but not necessarily wholly.

While compositions and methods are described herein in terms of "comprising" various components or steps, the compositions and methods can also "consist essentially of" or "consist of" the various components and steps. When "comprising" is used in a claim, it is open-ended.

The examples described herein are suitable for any oil and gas producing subterranean wellbore (onshore or offshore) to treat the volume of the wellbore above a DSV. The methods and systems permit prolonged contact time (also referred to as "soaking time") between a treatment fluid, typically comprising a treatment fluid additive (e.g., a scale-removal agent), and the volume of the wellbore above the DSV. As used herein, the term "treatment fluid," and grammatical variants thereof, refers to any fluid that may be used in a subterranean application in conjunction with a desired function and/or for a desired purpose (e.g., for scale removal). The term "treatment fluid" does not imply any particular action by the fluid or any component thereof. As described herein, the term "treatment fluid additive," and grammatical variants thereof (e.g., "treatment additive," "fluid additive," and the like), means a substance added to a treatment fluid to perform a specific function. For example, a scale-removal agent, as discussed in greater detail below, is a treatment fluid additive, as is a weighting agent, a gelling agent, a fluid-loss control agent, and the like. The term "contact time," as used herein and any grammatical variants thereof, refers to the time required between two substances in contact with one another (e.g., a scale-removal agent and scale, such as a surface having a scale deposit or coating) to effectuate a desired result (e.g., scale removal or dissolution).

Wellbores, whether offshore or onshore or of any wellbore trajectory (i.e., horizontal, vertical, or deviated), have a total volume. The "total volume" of the wellbore, and grammatical variants thereof (e.g., "wellbore total volume," "total wellbore volume," "total volume in the upper portion of the wellbore," "total volume in the bottom portion of the wellbore," and the like), as used herein, represents the complete fluid volume of a wellbore along its entire length. As used herein, the term "fluid" refers to both liquid fluids and gaseous fluids, unless otherwise specified. A DSV can be installed at a location along the length of a wellbore, taking into account various parameters including environmental concerns (e.g., the amount of fluid released from a wellbore in the event of DSV closure), potential cratering of wellbore risers above a surface (i.e., the earth's surface onshore or the seabed offshore), loss of hydraulic control of the DSV (e.g., if the DSV is too far down the wellbore, the weight of hydraulic fluid alone can apply sufficient pressure to keep the DSV open, even when loss of surface pressurization is intended to close the DSV), chemical plugging (e.g., methane hydrate plugs) forming due to certain pressures or temperatures, and the like. Typically, the DSV is located at a wellbore length taking into account these, and other, parameters that is at least 100 feet (30 meters) below the earth's surface or seabed, measured by true vertical depth (TVD). As used herein, the term "true vertical depth" or "TVD," and grammatical variants thereof, refers to the vertical distance from a point in a wellbore to a point at the surface. In some examples of the instant disclosure, the DSV is located about 2000 feet (600 meters) TVD. Accordingly, the DSV bisects the total volume of the wellbore into a volume above the DSV and a volume below the DSV.

As described above, the DSV is a failsafe component that is opened to allow fluids to traverse downward into a wellbore but can be closed to prevent the uncontrolled, upward movement of fluids to a surface location in the event of an emergency or catastrophe. Accordingly, the DSV can be opened (i.e., in an opened configuration) or closed (i.e., in a closed configuration), where when the DSV is open fluid flow is permitted and when the DSV is closed fluid flow is prevented. The DSV's described herein can be controlled electrically or hydraulically from the surface. That is, whether the DSV is open or closed can be selectively controlled by an operator at a surface location, such as in response to gathered data (e.g., wellbore, equipment, seismic data).

Additionally or alternatively, the DSV can be controlled simply by the pressure exerted upon the DSV by fluids as they are pumped into the wellbore and traverse past the DSV. In such circumstances, when the pressure above the DSV exceeds the pressure below the DSV, the DSV opens (e.g., the flapper valve opens), and where the pressure above the DSV is below the pressure below the DSV, the DSV closes (e.g., the flapper valve closes). Accordingly, the DSV may be operated from the surface hydraulically, electrically, or from fluid pressure alone either alternatively or in any combination. Indeed, it may be desirable to at least have hydraulic control and/or electrical control to ensure that the DSV provides the safety assurances desired.

In typical wellbores, treatment fluids may freefall due to gravity through a DSV, such that the top portion of a treatment fluid column is below the DSV. Accordingly, for example, treatment fluids introduced to remove or reduce scale buildup often do not have sufficient contact time with the volume of the wellbore above the DSV to be effective because the treatment fluid column drops below the DSV. That is, the treatment fluid is pumped from the surface and freefalls in an uncontrolled manner through the DSV, which is normally designed only to prevent fluid flow in an upward direction therethrough. This freefall is particularly evident in low pressure wellbores, where there may be insufficient reservoir pressure to support the hydrostatic column of the treatment fluid (e.g., aqueous-based fluids, oil-based fluids, and the like). Thus, low pressure wellbores comprising a DSV are particularly suitable for benefiting from the advantages described herein, such as increased contact time between a treatment fluid additive and the volume of a wellbore above a DSV. As used herein, the term "low pressure wellbore," and grammatical variants thereof, refers to a wellbore having a formation pressure that is less than the hydrostatic pressure from a liquid column extending from the bottom of the wellbore to the surface.

The examples provided herein accordingly describe a safe, reliable, simple, and economical way to treat the volume of a wellbore above a DSV with a treatment additive, and in particular a scale-removal agent, by preventing the freefall of treatment fluids comprising the additive. It is to be appreciated that although the examples described herein are made with reference to the use of a scale-removal agent as a treatment fluid additive in a treatment fluid for removing (e.g., by dissolution or other chemical reaction) scale from a volume of a wellbore above a DSV, the present disclosure may be employed additionally or alternatively for any treatment fluid additive in which it is desirable to achieve prolonged contact time (e.g., compared to traditional operations) between the additive in a treatment fluid and the volume of the wellbore above the DSV, including the DSV itself, without departing from the scope of the present disclosure. Adding to the simple and economical qualities of the presently disclosed methods and systems, the examples described herein do not require installation of isolation packers, which can be difficult, particularly when scale buildup exists that interferes with their actuation or setting, although wellbore isolation devices can be used in accordance with any of the embodiments described herein, without departing from the scope of the present disclosure, they are simply not required.

Referring now to FIGS. 1-6, illustrated are a series of cross-sectional diagrams of a wellbore system, where the volume of the wellbore above a DSV is treated with a scale-removal agent treatment fluid additive. The wellbore systems shown in FIGS. 1-6 depict an onshore (land-based) system; however, it is to be appreciated that like systems may be operated in subsea locations as well, without departing from the scope of the present disclosure. Similarly, the depicted well systems in FIGS. 1-6 show a vertical wellbore 102, the trajectory of the wellbore 102 may be vertical, horizontal, or deviated completely or at any location along the length of the wellbore 102, and in any combination, without departing from the scope of the present disclosure.

Referring first to FIG. 1, illustrated is a cross-sectional side view of a wellbore system 100 that may employ one or more principles of the present disclosure. More particularly, FIG. 1 depicts wellbore 102 in a subterranean formation 140 from the Earth's surface 104. A casing string 106 is secured within the wellbore 102, such as by a primary cementing operation or any other means. A well installation 108 is depicted as being arranged at the surface 104 and a production tubing 110 is suspended within the wellbore 102 from the wellhead installation 108. An annulus 114 is defined between the casing string 106 and the production tubing 110. The casing string 106 and production tubing 110 may comprise a plurality of tubular lengths coupled (e.g., threaded) together to form a continuous tubular conduit of a desired length, or may be a single tubular length or structure. A casing shoe (not shown) may be attached at the bottom-most portion of the production tubing 110. Production packers 142 are located in the annulus 114 to isolate portions of the formation 140 having hydrocarbon reservoirs adjacent thereto. Perforations (not shown) can be formed in the casing string 106 and/or production tubing 110 to allow hydrocarbons from a reservoir in the formation 140 to flow to the surface 104 for collection. The perforations may, in some examples, be at a TVD of about 9842 feet (or about 3000 meters).

At the surface 104, a feed line 116 may be operably and fluidly coupled to the wellhead installation 108 and in fluid communication with an interior 118 of the production tubing 110. The feed line 116 may have a feed valve 120 configured to regulate the flow of a fluid (e.g., the treatment fluids, gasses, and the like, described herein) into the interior 118 of the production tubing 110. The feed line 116 may be fluidly coupled to a source (not shown) of the fluid, such as a mixing tank, a storage tank, a gas source, and the like. A pump (e.g., a low-pressure pump, a high-pressure pump, or a combination thereof) may convey the fluid to the feed line 116 for pumping the fluid into the interior 118 of the production tubing 110. A return line 126 may also be connected to the wellhead installation 108 and in fluid communication with the annulus 114. In some cases, as illustrated, the return line 126 may include a return valve 128 configured to regulate the flow of fluids returning to the surface 104 via the annulus 114.

Wellbore 102 comprises a DSV 144. As an example, the DSV 144 is located at about 1968 feet (or about 600 meters) TVD. The wellbore 102 may be a low pressure wellbore that is on-vacuum. As used herein, the term "on vacuum," and grammatical variants thereof, refers to a wellbore that has a portion of its upper section (e.g., above the DSV 144) empty or only filled with unpressurized gas. An operator can control the open or closed configuration of the DSV 144 (e.g., electrically or hydraulically as described above). Alternatively or in addition, the DSV can also be forced to open by pumping fluid from the surface and exerting higher pressure above the DSV 144 (e.g., on the upper side of a flapper of the DSV 144) than the pressure below the DSV 144, without departing from the scope of the present disclosure.

As shown in FIG. 1, the wellbore 102 is on-vacuum and the DSV 144 is closed. The pressure above the DSV 144 may be about 0 bar (1 bar is equivalent to 100000 pascal). A fluid 146 is contained in the wellbore 102, as shown. The fluid 146 may be any fluid used during the production of the wellbore 102, including fluids that originate from the wellbore 102 (e.g., hydrocarbons). The fluid 146 exists below the DSV 144, such as at a TVD of about 3280 feet (or about 1000 meters). The pressure at the surface of the fluid 146 may be about 0.1 Bar, and thus higher than the pressure above the DSV 144. The pressure further down the wellbore 102 (e.g., at the location of one or more perforations) may be much higher, such as about 200 bar.

Figure 2:
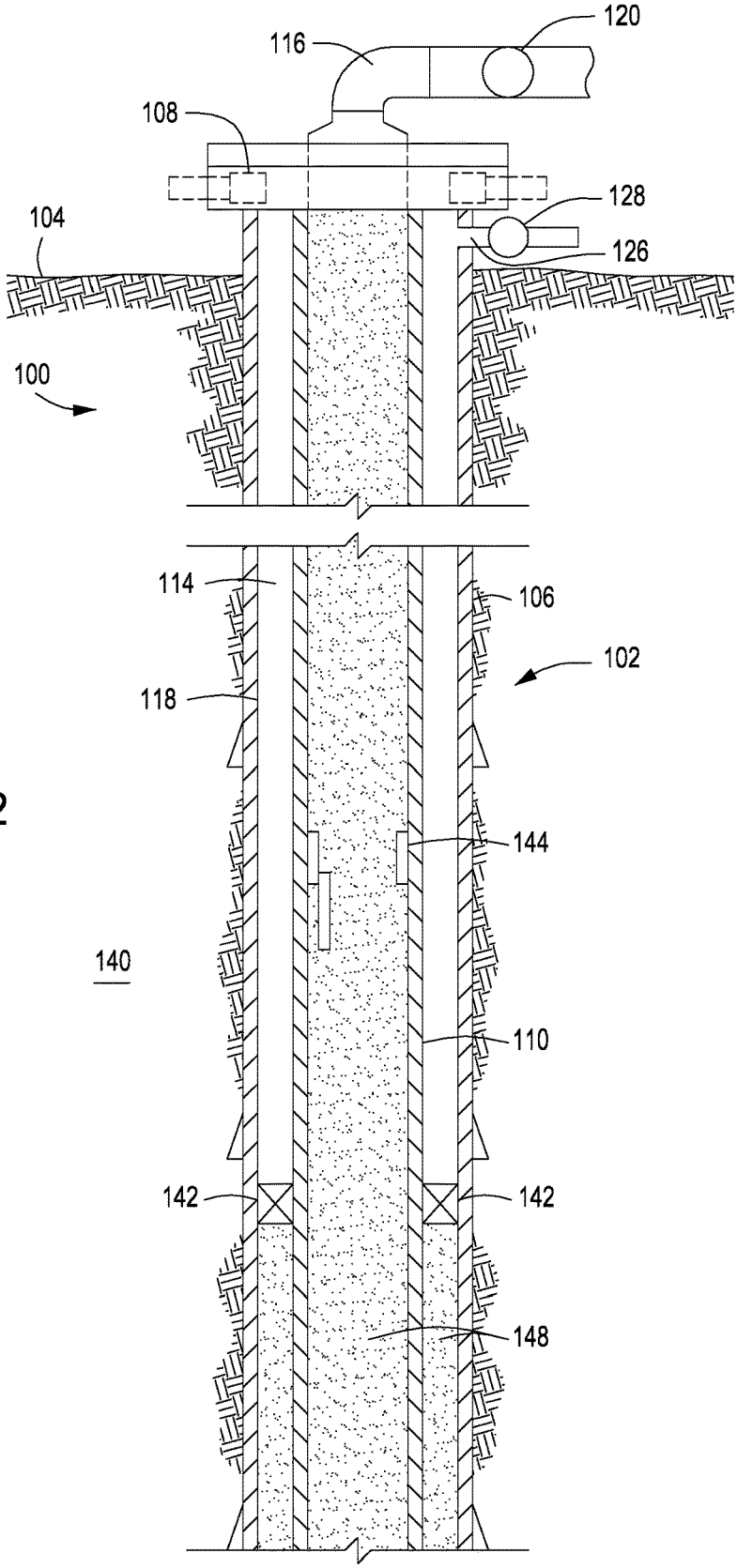

Referring now to FIG. 2, the DSV 144 is opened and a gas 148 is pumped into the wellbore 102 through the feedline 116, for example. The gas 148 causes the fluid 146 (FIG. 1) to be displaced toward the formation 140. Pumping the gas 148 into the wellbore 102 causes the surface pressure to increase substantially. For example, the pressure above the DSV 144 may be about 197 bar and the pressure below the DSV 144 (e.g., at the location of the top of the fluid 146 in FIG. 1) may be about 198 bar, both of which approach the pressure further down the wellbore 102 (e.g., at the location of one or more perforations), which may remain unaffected. The gas 148 may be any gaseous fluid, including a gas-foamed liquid, which has both a gaseous component and a liquid component). As used herein, the term "gas-foamed liquid," and grammatical variants thereof, refers to a two-phase composition having a continuous liquid phase and a discontinuous liquid phase. The gas-foamed liquids for use in the present disclosure preferably have a specific gravity that is lower than that of fresh water. Examples of suitable gases for use in the present disclosure include, but are not limited to, natural gas, nitrogen, carbon dioxide, a gas-foamed liquid thereof, and any combination thereof. Rather than using the gas 148 for displacing the fluid 146 (FIG. 1), it is also suitable for a liquid to be used, provided that the liquid has a specific gravity that is lower than the specific gravity of fresh water.

Figure 3:
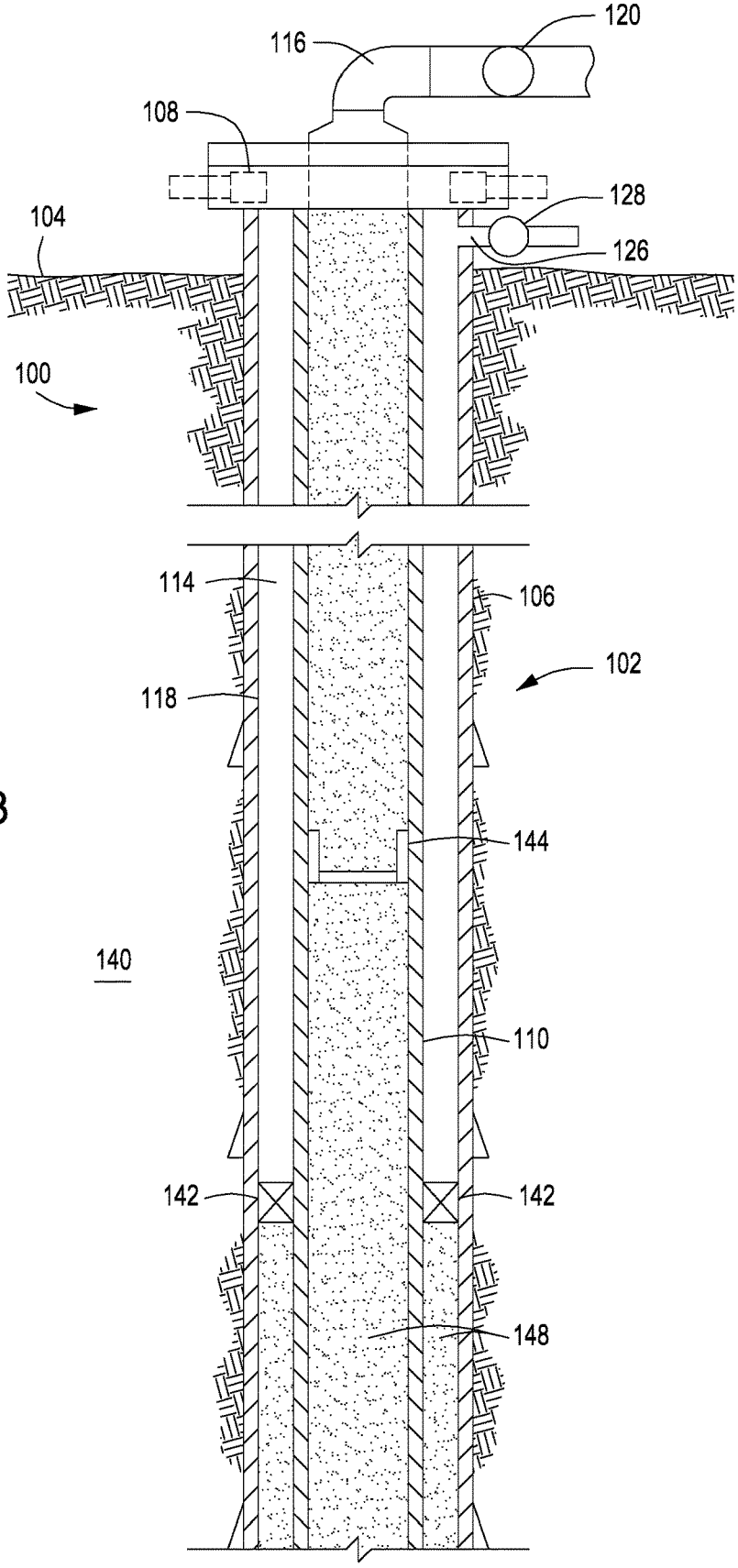

Referring now to FIG. 3, after the gas 148 has displaced the fluid 146 (FIG. 1), pumping of the gas 148 is stopped and the DSV 144 is closed. As shown, the fluid 146 (FIG. 1) has been completely displaced and the gas 148 fills all or about the total volume of the wellbore 102. Alternatively, the gas 148 may be pumped in an amount such that the gas 148 occupies at least about 50% of the total volume in the upper portion of the wellbore 102 (and the fluid 146 occupies about 50% or less of the total volume in the bottom portion of the wellbore 102), depending on the desired surface pressure to be achieved. Accordingly, the gas 148 may be pumped such that the gas 148 occupies at least about 50% of the total volume in the upper portion of the wellbore 102, and up to 100% of the total volume of the wellbore 102. Referring back to FIG. 3, at this point, the pressure just above and just below the DSV 144 is about equivalent to the reservoir pressure in the wellbore 102 due to the low specific gravity of the gas 148 filling the total volume of the wellbore 102. As used herein, the term "reservoir pressure," and grammatical variants thereof, refers to the pressure of subsurface formation fluids within a subterranean formation, such as around one or more perforations. That is, like in FIG. 2, the pressure above the DSV 144 may be about 197 bar and the pressure below the DSV 144 (e.g., at the location of the top of the fluid 146 in FIG. 1) may be about 198 bar, both of which approach the pressure further down the wellbore 102 (e.g., at the location of one or more perforations), which may remain unaffected.

Figure 4:
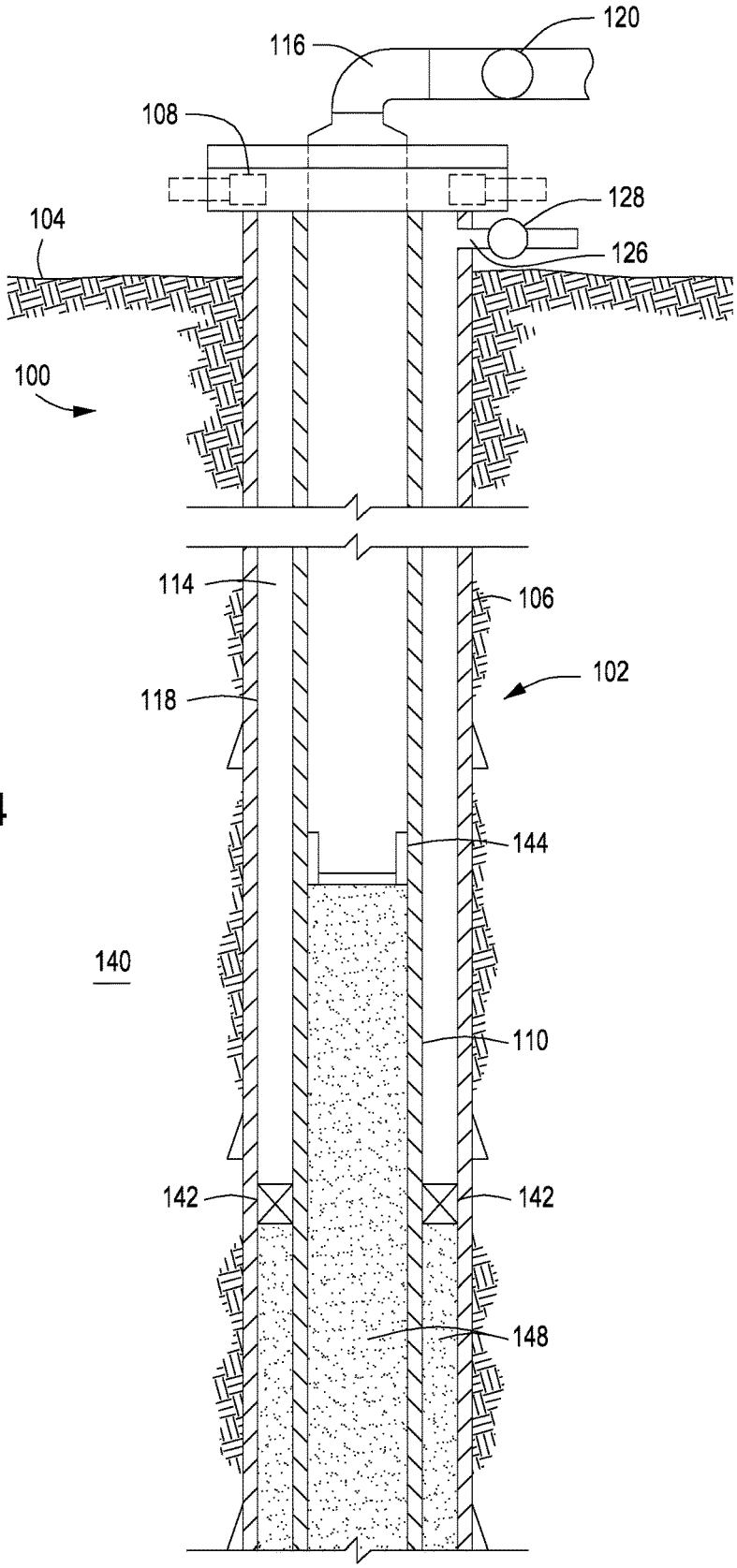

As shown in FIG. 4, once the gas 148 pumping is stopped and the DSV 144 is closed, the gas 148 above the DSV 144 is bled off or otherwise released to the surface 104. Accordingly, the gas 148 remains in the volume of the wellbore 102 below the DSV 144. Releasing the gas 148 above the DSV 144 creates a differential pressure over the DSV 144, such that the pressure above the DSV 144 is less (generally substantially less) than the pressure below the DSV, which causes the DSV 144 to remain closed. For example, the pressure above the DSV 144 may be about 0 bar and the pressure below the DSV 144 (e.g., at the location of the top of the fluid 146 in FIG. 1) may be unaffected, and thus about 198 bar. In preferred embodiments, it is desirable that releasing the gas 148 from the volume above the DSV 144 results in at least about 5 bar higher pressure just below the DSV 144 compared to just above the DSV 144.

Figure 5:
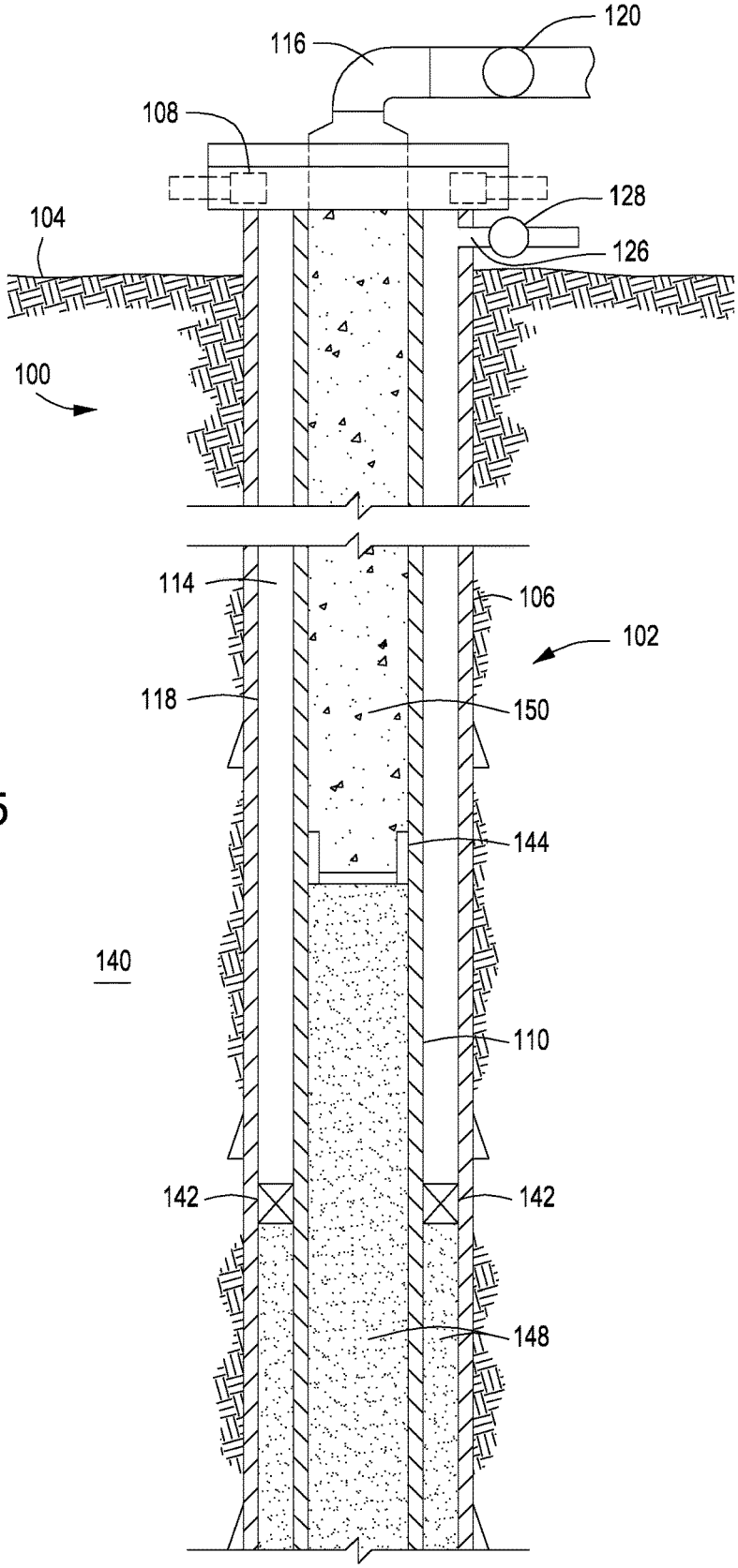

Referring now to FIG. 5, a treatment fluid 150 comprising at least a base fluid and a scale-removal agent is pumped into the wellbore 102 through the feedline 116 at a pumping pressure that does not force open the DSV 114. That is, the sum of the pumping pressure and the hydrostatic pressure of the treatment fluid 150 is lower than the pressure that is being experienced in the volume of the wellbore 102 below the DSV 144. For example, the pressure experienced in the volume of the wellbore 102 above the DSV 144 (e.g., by pumping the treatment fluid 150 and/or by the mere existence of the treatment fluid 150 in the wellbore 102) may be about 60 bar, and the pressure below the DSV 144 (e.g., at the location of the top of the fluid 146 in FIG. 1) may be unaffected, and thus about 198 bar. In some instances, the treatment fluid 150 may have a specific gravity of about 1 (e.g., equivalent to fresh water).

The treatment fluid 150 is pumped into the wellbore 102 to fill the entire volume of the wellbore 102 above the DSV 144. Alternatively, the treatment fluid 150 may be pumped into the wellbore to only partially fill the volume of the wellbore 102 above the DSV 144 in an amount so as to fully contact the DSV 144 (i.e., the entire upper portion of the DSV 144 in the volume of the wellbore 102 above the DSV 144). For example, in one instance, at least about a volume of treatment fluid 150 equivalent to about 25% of the volume of the wellbore 102 above the DSV 144 is pumped. Thus, the treatment fluid 150 may contact only the DSV 144 in the volume of the wellbore 102 above the DSV 144 or, alternatively, the treatment fluid 150 may contact the DSV 144 in addition to any length of the wellbore 102 in the volume of the wellbore 102 above the DSV 144 up to the entire volume of the wellbore 102 above the DSV. Accordingly, the volume of the treatment fluid 150 that is pumped into the wellbore is preferably a volume that is less than the volume of the wellbore 102 above the DSV 144, which will vary depending on the location of the DSV 144 within the wellbore 102. In preferred embodiments, the volume of the treatment fluid 150 that is pumped into the wellbore 102 is selected such that it is equivalent to about 10% less than the volume of the wellbore 102 above the DSV 144 so as to keep the surface pressure as close to 0 bar as possible. Once the volume of treatment fluid 150 has been selected and pumped, pumping is terminated and, as shown in FIG. 5, the treatment fluid 150 is in the volume of the wellbore 102 above the DSV 144, and the gas 148 remains in the volume of the wellbore 102 below the DSV 144.

As provided above, the treatment fluid 150 comprises at least a base fluid and a scale-removal agent. Thus, the scale-removal agent in the treatment fluid 150 can react with scale in the volume of the wellbore 102 above the DSV 144 to remove the scale, such that it becomes suspended or otherwise dissolved within the treatment fluid 150. As used herein, the term "remove," and grammatical variants thereof, with reference to scale encompasses any mechanism of chemical removal, such as dissolution, degradation, and the like. After the treatment fluid 150 is left in the volume of the wellbore 102 above the DSV 144 for a period of time sufficient to allow the scale-removal agent to remove scale therein, the DSV 144 is opened and the treatment fluid 150 (now comprising the removed scale) and the gas 148 are produced from the wellbore 102 and to the surface 104. As used herein, the term "producing," and grammatical variants thereof (e.g., "produced," "producing the well," "producing the gas," and the like), refers to removing one or more fluids from the wellbore and to the surface. The DSV 144 may be opened from the surface 104 (e.g., hydraulically or electrically) or may be opened by pumping a displacement fluid into the wellbore at a pressure that will cause the DSV 144 to open. That is, the displacement fluid is pumped at a pressure that is greater than the pressure experienced below the DSV 144.

After producing the gas 148 and the treatment fluid 150 from the wellbore 102, one or more repetitions of the above-described method may be repeated, without departing from the scope of the present disclosure. That is, the DSV 144 is opened and a gas 148 is introduced into the total volume of the wellbore 102, the DSV 144 is then closed, the gas 148 is released from the volume of the wellbore 102 above the DSV 144, a treatment fluid 150 is pumped into the volume of the wellbore 102 above the DSV 144 where it is held for a period of time to remove scale from the volume of the wellbore 102 above the DSV 144, the DSV 144 is opened and the gas 148 and treatment fluid 150 are produced to the surface 104. Subsequent treatment fluids can have one or more of the same scale-removal agents or different types of scale-removal agents, without departing from the scope of the present disclosure. That is, regardless of the number of iterations of the method described herein, the treatment fluids may be compositionally the same or compositionally different in terms of base fluid, scale-removal agent, and any other additives included therein.

Figure 6:
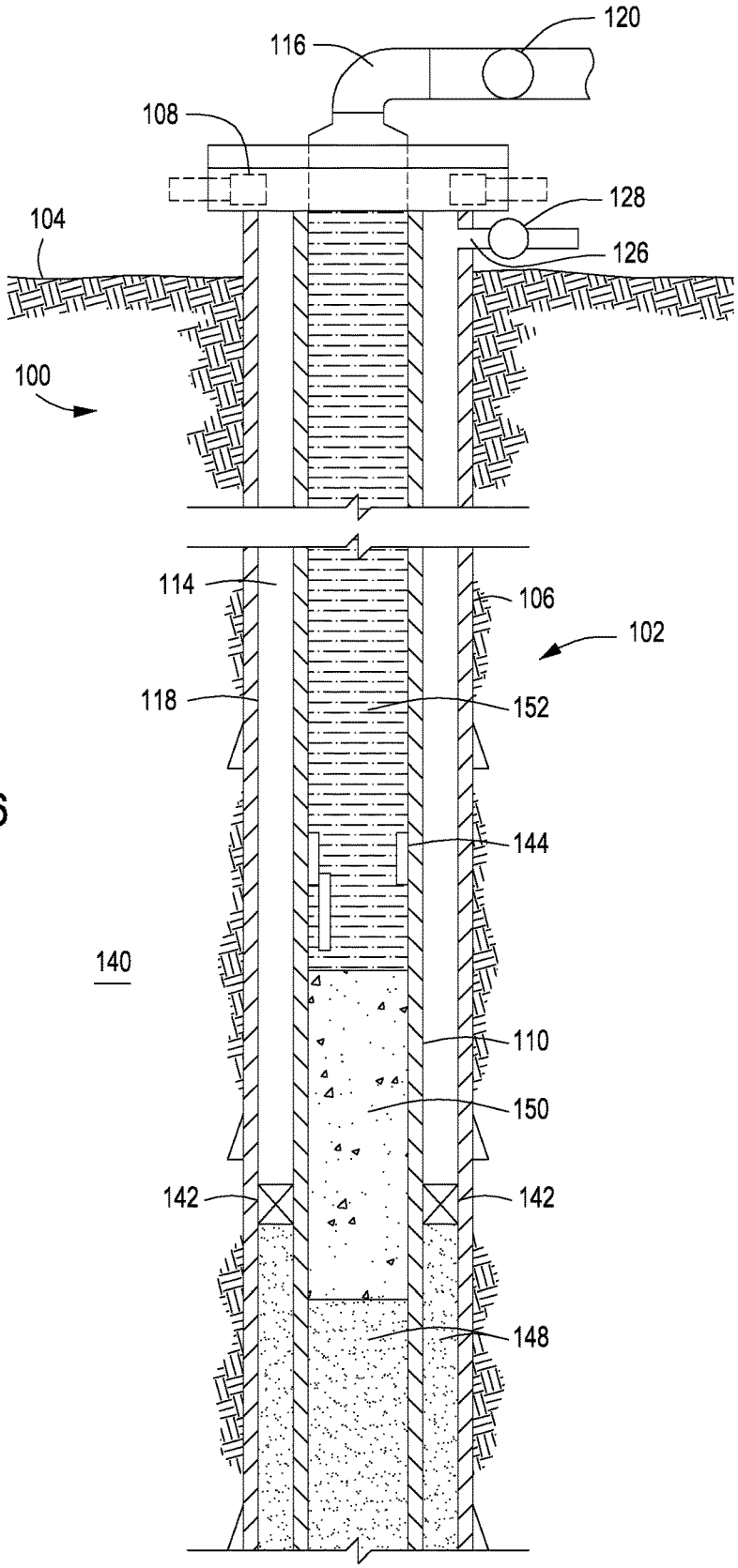
FIGS. 6-8 are a series of cross-sectional illustrations of a wellbore system being treated for scale remediation at and above a DSV.

In certain instances, rather than producing the gas 148 and treatment fluid 150 to the surface 104 after the treatment fluid 150 has removed scale and any additional iterations of treatment, as described above, one or more subsequent treatment fluids comprising a scale-removal agent can be introduced to remove scale in the volume of the wellbore 102 above the DSV 144 prior to producing the well. Referring now to FIG. 6, after the treatment fluid 150 has been allowed to remove scale from the volume of the wellbore 102 above the DSV 144, the DSV 144 is again opened and a subsequent gas 152 is pumped into the wellbore 102 to displace the treatment fluid 150 into the volume of the wellbore 102 below the DSV 144.

Figure 7:
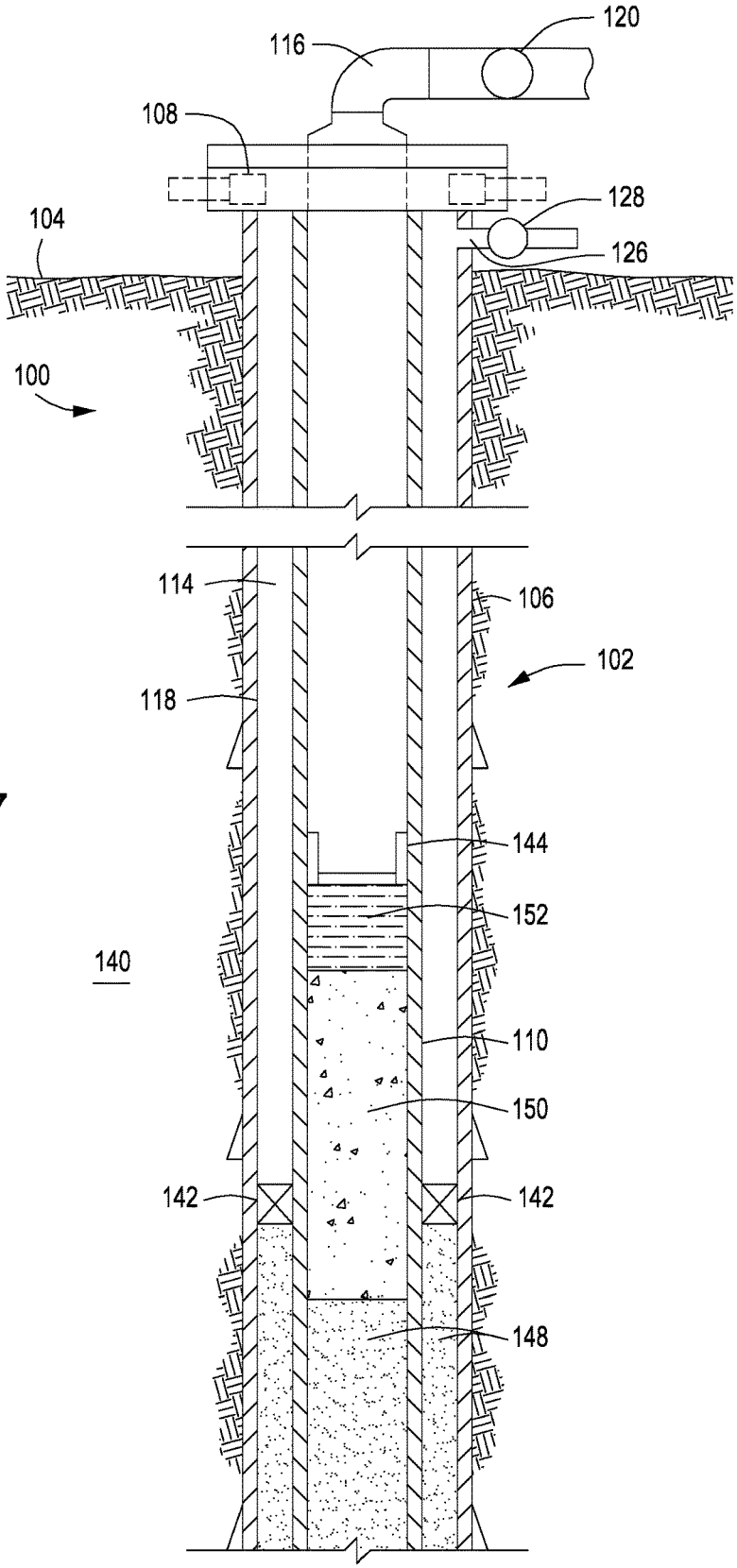

As shown in FIG. 7, once the subsequent gas 152 pumping is stopped and the DSV 144 is again closed, and the subsequent gas 152 above the DSV 144 is bled off or otherwise released to the surface 104. Accordingly, the gas 148, the treatment fluid 152, and a portion of the subsequent gas 152 remains in the volume of the wellbore 102 below the DSV 144. As discussed above with reference to the gas 148, releasing the subsequent gas 152 above the DSV 144 creates a differential pressure over the DSV 144, such that the pressure above the DSV 144 is less than the pressure below the DSV, which causes the DSV 144 to remain closed. In preferred embodiments, it is desirable that the differential pressure created from releasing the gas 148 is such that the pressure below the DSV 144 (e.g., at the location of the top of the fluid 146 in FIG. 1) is at least about 5 bar higher than the pressure at or above the DSV 144.

Figure 8:
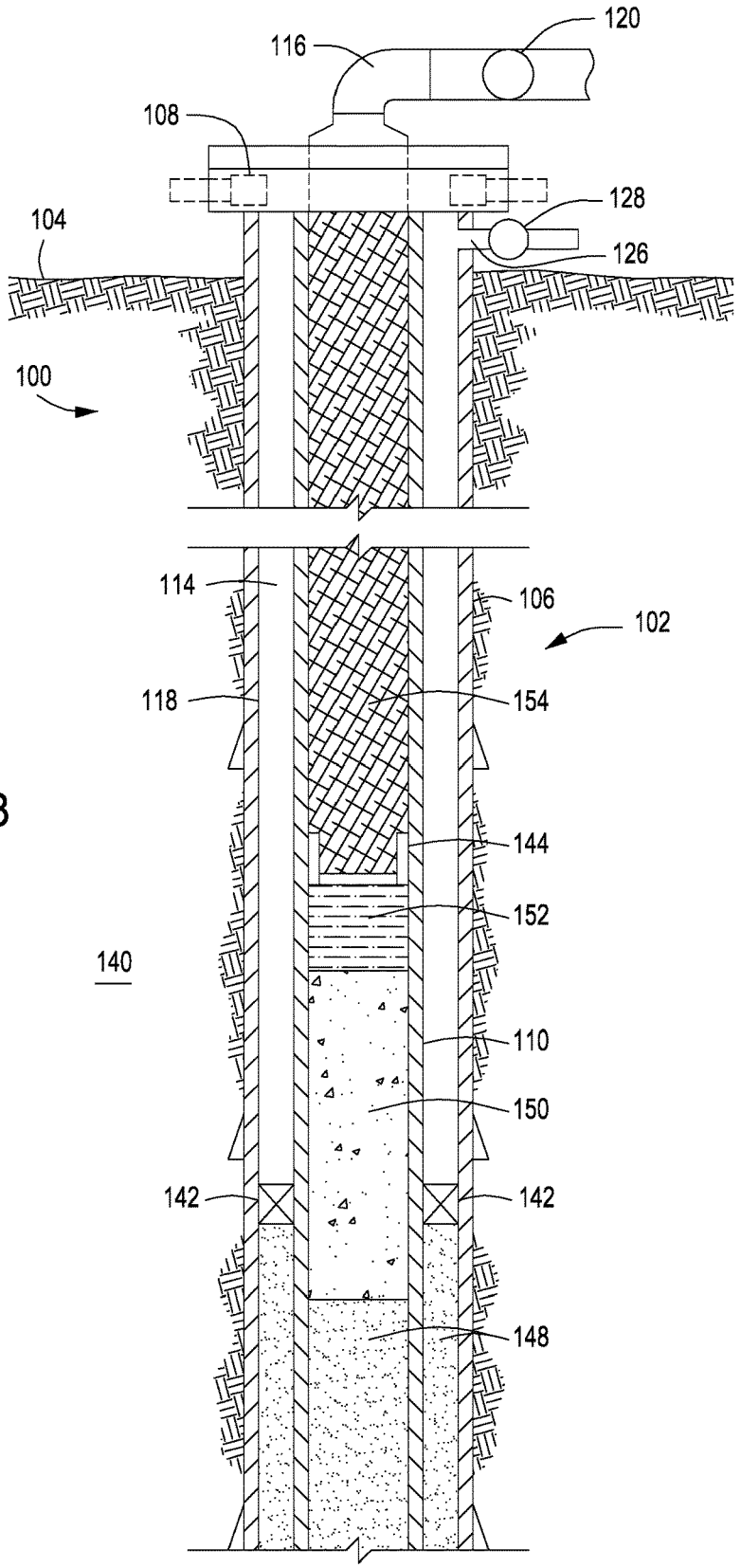

Referring now to FIG. 8, a subsequent treatment fluid 154 comprising at least a base fluid and a scale-removal agent (which can be compositionally the same or different as the treatment fluid 150) is pumped into the wellbore 102 through the feedline 116 at a pumping pressure that does not force open the DSV 114. Thus, the sum of the pumping pressure and the hydrostatic pressure in which the subsequent treatment fluid 154 is pumped into the wellbore 102 is a pressure that is lower than the pressure that is being experienced in the volume of the wellbore 102 below the DSV 144. In some instances, the treatment fluid 154 may have a specific gravity of about 1 (e.g., equivalent to fresh water).

Similar to the treatment fluid 150, the subsequent treatment fluid 154 is pumped into the wellbore 102 to fill the entire volume of the wellbore 102 above the DSV 144. Alternatively, the subsequent treatment fluid 154 may be pumped into the wellbore to only partially fill the volume of the wellbore 102 above the DSV 144 in an amount so as to fully contact the DSV 144 (i.e., the entire upper portion of the DSV 144 in the volume of the wellbore 102 above the DSV 144). For example, in one instance, at least about a volume of subsequent treatment fluid 154 equivalent to about 25% of the volume of the wellbore 102 above the DSV 144 is pumped. Thus, subsequent treatment fluid 154 may contact only the DSV 144 in the volume of the wellbore 102 above the DSV 144 or, alternatively, the subsequent treatment fluid 154 may contact the DSV 144 in addition to any length of the wellbore 102 in the volume of the wellbore 102 above the DSV 144 up to the entire volume of the wellbore 102 above the DSV. Accordingly, the volume of the subsequent treatment fluid 154 that is pumped into the wellbore is preferably a volume that is less than the volume of the wellbore 102 above the DSV 144, which will vary depending on the location of the DSV 144 within the wellbore 102. In preferred embodiments, the volume of the subsequent treatment fluid 154 that is pumped into the wellbore 102 is selected such that it is equivalent to about 10% less than the volume of the wellbore 102 above the DSV 144. Once the volume of subsequent treatment fluid 154 has been selected and pumped, pumping is terminated and, as shown in FIG. 8, the subsequent treatment fluid 154 is in the volume of the wellbore 102 above the DSV 144, and the gas 148, the treatment fluid 150, and the subsequent gas 152 remains in the volume of the wellbore 102 below the DSV 144.

The scale-removal agent in the subsequent treatment fluid 154 is then allowed to react with scale in the volume of the wellbore 102 above the DSV 144 to remove the scale, such that it becomes suspended or otherwise dissolved within the subsequent treatment fluid 154. After the subsequent treatment fluid 154 is left in the volume of the wellbore 102 above the DSV 144 for a period of time sufficient to allow the scale-removal agent to remove scale therein, the DSV 144 is opened and the subsequent treatment fluid 154 (now comprising the removed scale), the subsequent gas 152, the treatment fluid 150 (also comprising removed scale), and the gas 148 are produced from the wellbore 102 and to the surface 104. The DSV 144 may be opened from the surface 104 (e.g., hydraulically or electrically) or may be opened by pumping a displacement fluid into the wellbore at a pressure that will cause the DSV 144 to open.

After producing the subsequent treatment fluid 154, the subsequent gas 152, the treatment fluid 150, and the gas 148 from the wellbore 102, one or more repetitions of the above-described method may be repeated, without departing from the scope of the present disclosure. That is, the DSV 144 is opened and a subsequent gas 152 is introduced into the wellbore 102 to displace other fluids into the volume of the wellbore 102 below the DSV 144, the DSV 144 is then closed, the subsequent gas 152 is released from the volume of the wellbore 102 above the DSV 144, a subsequent treatment fluid 154 is pumped into the volume of the wellbore 102 above the DSV 144 where it is held for a period of time to remove scale from the volume of the wellbore 102 above the DSV 144, the DSV 144 is opened and the various fluids within the wellbore 102 are produced to the surface 104. Subsequent treatment fluids can have one or more of the same scale-removal agents or different types of scale-removal agents, without departing from the scope of the present disclosure. That is, regardless of the number of iterations of the method described herein, the treatment fluids may be compositionally the same or compositionally different in terms of base fluid, scale-removal agent, and any other additives included therein. Similarly, subsequent gases can be the same or different gases, without departing from the scope of the present disclosure.

As previously stated, the term "scale," and grammatical variants thereof, refers to a deposit or coating formed on the surface of a metal, rock, or other material. The scale-removal agents described herein are selected to remove one or more types of scale in the volume of the wellbore 102 above the DSV 144 including both organic and inorganic scale types. Examples of scale that the scale-removal agents described herein are able to remove include, but not limited to, calcium carbonate scale, calcium sulfate scale, barium sulfate scale, strontium sulfate scale, iron sulfide scale, iron oxide scale, iron carbonate scale, silicate scale, phosphate scale, oxide scale, an asphaltene scale, a paraffin scale, and the like, and any combination thereof.

The various treatment fluids described herein (e.g., treatment fluid 150 and subsequent treatment fluid 154) comprise at least a base fluid and a scale-removal agent. The base fluid may be any fluid suitable for use in a wellbore and capable of delivering the scale-removal agent thereto. Suitable base fluids include, but are not limited to, oil-based fluids, aqueous-based fluids, aqueous-miscible fluids, water-in-oil emulsions, oil-in-water emulsions, and any combination thereof. Suitable oil-based fluids may include alkanes, olefins, aromatic organic compounds, cyclic alkanes, paraffins, diesel fluids, mineral oils, desulfurized hydrogenated kerosenes, and any combination thereof. Suitable aqueous-based fluids may include fresh water, saltwater (e.g., water containing one or more salts dissolved therein), brine (e.g., saturated salt water), seawater, produced water, wastewater, and any combination thereof. Suitable aqueous-miscible fluids may include, but are not limited to, alcohols (e.g., methanol, ethanol, n-propanol, isopropanol, n-butanol, sec-butanol, isobutanol, and t-butanol), glycerins, glycols (e.g., polyglycols, propylene glycol, and ethylene glycol), polyglycol amines, polyols, any derivative thereof, any in combination with salts (e.g., sodium chloride, calcium chloride, calcium bromide, zinc bromide, potassium carbonate, sodium formate, potassium formate, cesium formate, sodium acetate, potassium acetate, calcium acetate, ammonium acetate, ammonium chloride, ammonium bromide, sodium nitrate, potassium nitrate, ammonium nitrate, ammonium sulfate, calcium nitrate, sodium carbonate, and potassium carbonate), any in combination with an aqueous-based fluid, and any combination thereof. Any of the aforementioned base fluids, with or without additional additives, may further be used as a displacement fluid as described above.

The scale-removal agents for use in removing scale at or around a DSV and the volume of the wellbore above the DSV include any substance capable of chemically removing (e.g., dissolving) scale, including the scale types described above. The scale-removal agents include, but are not limited to, a chelating agent, an acid, a solvent, a hydroxide, and any combination thereof.

Suitable chelating agents for use as the scale-removal agent described herein include, but are not limited to, methylglycine diacetic acid, (β-alanine diacetic acid, ethylenediaminedisuccinic acid, S,S-ethylenediaminedisuccinic acid, iminodisuccinic acid, hydroxyiminodisuccinic acid, polyamino disuccinic acids, N-bis[2-(1,2-dicarboxyethoxy)ethyl]glycine, N-bis[2-(1,2-dicarboxyethoxy)ethyl]aspartic acid, N-bis[2-(1,2-dicarboxyethoxy)ethyl]methylglycine, N-tris[(1,2-dicarboxyethoxy)ethyl]amine, N-methyliminodiacetic acid, iminodiacetic acid, N-(2-acetamido)iminodiacetic acid, hydroxymethyl-iminodiacetic acid, 2-(2-carboxyethylamino)succinic acid, 2-(2-carboxymethylamino)succinic acid, diethylenetriamine-N,N''-disuccinic acid, triethylenetetramine-N,N'''-disuccinic acid, 1,6-hexamethylenediamine-N,N'-disuccinic acid, tetraethylenepentamine-N,N'''-disuccinic acid, 2-hydroxypropylene-1,3-diamine-N,N'-disuccinic acid, 1,2-propylenediamine-N,N'-disuccinic acid, 1,3-propylenediamine-N,N'-disuccinic acid, cis-cyclohexanediamine-N,N'-disuccinic acid, trans-cyclohexanediamine-N,N'-disuccinic acid, ethylenebis(oxyethylenenitrilo)-N,N'-disuccinic acid, glucoheptanoic acid, cysteic acid-N,N-diacetic acid, cysteic acid-N-monoacetic acid, alanine-N-monoacetic acid, N-(3-hydroxysuccinyl)aspartic acid, N-[2-(3-hydroxysuccinyl)]-L-serine, aspartic acid-N,N-diacetic acid, aspartic acid-N-monoacetic acid, any salt thereof, any derivative thereof, and any combination thereof.

Suitable acids for use as the scale-removal agent described herein include, but are not limited to, hydrochloric acid, acetic acid, formic acid, citric acid, glutamic acid, diacetic acid, hydrofluoric acid, and any combination thereof. Solvents for use as the scale-removal agent described herein may be aromatic solvents, organic solvents, halogenated solvents, and any combination thereof. Examples of suitable solvents include, but are not limited to, toluene, xylene, benzene, kerosene, gasoline, chloroform, methylene chloride, dichloromethane, methylene chloride, trichloroethylene, styrene, terpene, cyclohexanone, D-limonene, dipentene, N-methyl pyrrolidone, cyclohexanone, naphthalene, nitrobenzene, phenol, m-nitrophenol, trichloroethylene, perchloroethylene, dichloroethylene, vinyl chloride, polycarbonated biphenyl, and any combination thereof. Suitable hydroxides for use as the scale-removal agents of the present disclosure are alkali hydroxides including, but not limited to, lithium hydroxide, sodium hydroxide, potassium hydroxide, rubidium hydroxide, caesium hydroxide, and any combination thereof.

In some embodiments, the treatment fluids described herein may further include a treatment fluid additive that serves a purpose other than for scale removal (e.g., a suspension aid), without departing from the scope of the present disclosure. Examples of suitable additives include, but are not limited to, a salt, a weighting agent, an inert solid, a fluid loss control agent, an emulsifier, a dispersion aid, a corrosion inhibitor, an emulsion thinner, an emulsion thickener, a viscosifying agent, a gelling agent, a surfactant, a foaming agent, a gas, a pH control additive, a breaker, a biocide, a crosslinker, a stabilizer, a scale inhibitor, a gas hydrate inhibitor, a mutual solvent, an oxidizer, a reducer, a friction reducer, and any combination thereof.

Examples disclosed herein include:

EXAMPLE A

A method comprising: (a) providing a wellbore in a subterranean formation extending from a surface, the wellbore having a total volume and a fluid therein; wherein the wellbore includes a downhole safety valve (DSV), such that the total volume of the wellbore includes a volume above the DSV and a volume below the DSV, wherein the DSV can be closed or opened, and wherein the DSV is closed; (b) opening the DSV; (c) introducing a gas into the wellbore having the DSV opened, thereby displacing the fluid in the wellbore with the gas, such that the gas occupies at least about 50% of the total volume of the wellbore; (d) closing the DSV; (e) releasing the gas from the volume of the wellbore above the closed DSV, thereby reducing the pressure above the DSV compared to the pressure below the DSV while the DSV remains closed; (f) pumping a first treatment fluid comprising a base fluid and a scale-removal agent into the wellbore at a pumping pressure that does not force open the DSV, thereby retaining the first treatment fluid in the volume of the wellbore above the DSV; (g) terminating pumping; (h) removing scale from the volume of the wellbore above the DSV with the scale-removal agent in the first treatment fluid; (i) opening the DSV; and (j) producing the well to remove at least the gas and the first treatment fluid from the wellbore.

Example A may have one or more of the following additional elements in any combination:

Element A1: Wherein the DSV is operated hydraulically or electrically from surface.

Element A2: Further comprising repeating (b) through (j) at least once.

Element A3: Wherein the treatment fluid pumped in (f) has a volume less than the volume of the wellbore above the DSV.

Element A4: Wherein the wellbore is a low pressure wellbore.

Element A5: Wherein the gas is selected from the group consisting of natural gas, nitrogen, carbon dioxide, air, a gas-foamed liquid thereof, and any combination thereof.

Element A6: Wherein the scale-removal agent is selected from the group consisting of a chelating agent, an acid, a solvent, a hydroxide, and any combination thereof.

Element A7: Wherein the scale-removal agent is a chelating agent selected from the group consisting of methylglycine diacetic acid, (β-alanine diacetic acid, ethylenediaminedisuccinic acid, S,S-ethylenediaminedisuccinic acid, iminodisuccinic acid, hydroxyiminodisuccinic acid, polyamino disuccinic acids, N-bis[2-(1,2-dicarboxyethoxy)ethyl]glycine, N-bis[2-(1,2-dicarboxyethoxy)ethyl]aspartic acid, N-bis[2-(1,2-dicarboxyethoxy)ethyl]methylglycine, N-tris[(1,2-dicarboxyethoxy)ethyl]amine, N-methyliminodiacetic acid, iminodiacetic acid, N-(2-acetamido)iminodiacetic acid, hydroxymethyl-iminodiacetic acid, 2-(2-carboxyethylamino)succinic acid, 2-(2-carboxymethylamino)succinic acid, diethylenetriamine-N,N''-disuccinic acid, triethylenetetramine-N,N'''-disuccinic acid, 1,6-hexamethylenediamine-N,N'-disuccinic acid, tetraethylenepentamine-N,N'''-disuccinic acid, 2-hydroxypropylene-1,3-diamine-N,N'-disuccinic acid, 1,2-propylenediamine-N,N'-disuccinic acid, 1,3-propylenediamine-N,N'-disuccinic acid, cis-cyclohexanediamine-N,N'-disuccinic acid, trans-cyclohexanediamine-N,N'-disuccinic acid, ethylenebis(oxyethylenenitrilo)-N,N'-disuccinic acid, glucoheptanoic acid, cysteic acid-N,N-diacetic acid, cysteic acid-N-monoacetic acid, alanine-N-monoacetic acid, N-(3-hydroxysuccinyl)aspartic acid, N-[2-(3-hydroxysuccinyl)]-L-serine, aspartic acid-N,N-diacetic acid, aspartic acid-N-monoacetic acid, any salt thereof, any derivative thereof, and any combination thereof.

Element A8: Wherein the scale-removal agent is an acid selected from the group consisting of hydrochloric acid, acetic acid, formic acid, citric acid, glutamic acid, diacetic acid, ethylenediamine tetraacetic acid, hydrofluoric acid, and any combination thereof.

Element A9: Wherein the scale-removal agent is a solvent selected from the group consisting of an aromatic solvent, an organic solvent, a halogenated solvent, and any combination thereof.

Element A10: Wherein the scale-removal agent is a hydroxide selected from the group consisting of lithium hydroxide, sodium hydroxide, potassium hydroxide, rubidium hydroxide, caesium hydroxide, and any combination thereof.

Element A11: Wherein the base fluid is selected from the group consisting of an oil-based fluid, an aqueous-based fluid, an aqueous-miscible fluid, a water-in-oil emulsion, an oil-in-water emulsion, and any combination thereof.

By way of non-limiting example, exemplary combinations applicable to A include: A1-A11; A1, A3, and A7; A6 and A8; A2, A9, and A10; A6 and A9; A8, A9, and A10; A3, A5, and A6; A2, A5, and A7; and the like.

EXAMPLE B

A method comprising: (a) providing a wellbore in a subterranean formation extending from a surface location, the wellbore having a total volume and a fluid therein; wherein the wellbore includes a downhole safety valve (DSV), such that the total volume of the wellbore includes a volume above the DSV and a volume below the DSV, wherein the DSV can be closed or opened, and wherein the DSV is closed unless a pressure above the DSV exceeds a pressure below the DSV, thereby forcing open the DSV; (b) opening the DSV; (c) introducing a gas into the wellbore having the DSV opened, thereby displacing the fluid in the wellbore with the gas, such that the gas occupies at least about 50% of the total volume of the wellbore; (d) closing the DSV; (e) releasing the gas from the volume of the wellbore above the closed DSV, thereby reducing the pressure above the DSV compared to the pressure below the DSV while the DSV remains closed; (f) pumping a first treatment fluid comprising a first base fluid and a first scale-removal agent into the wellbore at a first pumping pressure that does not force open the DSV, thereby retaining the first treatment fluid in the volume of the wellbore above the DSV; (g) terminating pumping; (h) removing scale from the volume of the wellbore above the DSV with the first scale-removal agent in the first treatment fluid, thereby causing the scale to dissolve or suspend within the first treatment fluid; (i) opening the DSV; (j) introducing a subsequent gas into the wellbore having the DSV opened, thereby displacing the first treatment fluid into the volume of the wellbore below the DSV with the subsequent gas; (k) closing the DSV; (l) releasing the subsequent gas from the volume of the wellbore above the closed DSV, thereby reducing the pressure above the DSV compared to the pressure below the DSV while the DSV remains closed; (m) pumping a subsequent treatment fluid comprising a second base fluid and a second scale-removal agent at a second pumping pressure that does not force open the DSV, thereby retaining the subsequent treatment fluid in the volume of the wellbore above the DSV; (n) terminating pumping; (o) removing scale from the volume of the wellbore above the DSV with the second scale-removal agent in the subsequent treatment fluid; (p) opening the DSV; and (q) producing the well to remove at least the gas, the first treatment fluid, the subsequent gas, and the subsequent treatment fluid from the wellbore.

Example B may have one or more of the following additional elements in any combination:

Element B1: Wherein the DSV is operated wherein the DSV is operated hydraulically or electrically from surface.

Element B2: Further comprising repeating (j) through (o) at least once.

Element B3: Wherein the first treatment fluid pumped in (f) has a volume less than the volume of the wellbore above the DSV.

Element B4: Wherein the subsequent treatment fluid pumped in (m) has a volume less than the volume of the wellbore above the DSV.

Element B5: Wherein the wellbore is a low pressure wellbore.

Element B6: Wherein the gas and the subsequent gas are selected from the group consisting of natural gas, nitrogen, carbon dioxide, air, a gas-foamed liquid thereof, and any combination thereof.

Element B7: Wherein the first scale-removal agent and the second scale-removal agent are selected from the group consisting of a chelating agent, an acid, a solvent, a hydroxide, and any combination thereof.

Element B8: Wherein the first scale-removal agent and/or the second scale-removal agent is a chelating agent selected from the group consisting of methylglycine diacetic acid, β-alanine diacetic acid, ethylenediaminedisuccinic acid, S,S-ethylenediaminedisuccinic acid, iminodisuccinic acid, hydroxyiminodisuccinic acid, polyamino disuccinic acids, N-bis[2-(1,2-dicarboxyethoxy)ethyl]glycine, N-bis[2-(1,2-dicarboxyethoxy)ethyl]aspartic acid, N-bis[2-(1,2-dicarboxyethoxy)ethyl]methylglycine, N-tris[(1,2-dicarboxyethoxy)ethyl]amine, N-methyliminodiacetic acid, iminodiacetic acid, N-(2-acetamido)iminodiacetic acid, hydroxymethyl-iminodiacetic acid, 2-(2-carboxyethylamino)succinic acid, 2-(2-carboxymethylamino)succinic acid, diethylenetriamine-N,N''-disuccinic acid, triethylenetetramine-N,N'''-disuccinic acid, 1,6-hexamethylenediamine-N,N'-disuccinic acid, tetraethylenepentamine-N,N'''-disuccinic acid, 2-hydroxypropylene-1,3-diamine-N,N'-disuccinic acid, 1,2-propylenediamine-N,N'-disuccinic acid, 1,3-propylenediamine-N,N'-disuccinic acid, cis-cyclohexanediamine-N,N'-disuccinic acid, trans-cyclohexanediamine-N,N'-disuccinic acid, ethylenebis(oxyethylenenitrilo)-N,N'-disuccinic acid, glucoheptanoic acid, cysteic acid-N,N-diacetic acid, cysteic acid-N-monoacetic acid, alanine-N-monoacetic acid, N-(3-hydroxysuccinyl)aspartic acid, N-[2-(3-hydroxysuccinyl)]-L-serine, aspartic acid-N,N-diacetic acid, aspartic acid-N-monoacetic acid, any salt thereof, any derivative thereof, and any combination thereof.

Element B9: Wherein the first scale-removal agent and/or the second scale-removal agent is an acid selected from the group consisting of hydrochloric acid, acetic acid, formic acid, citric acid, glutamic acid, diacetic acid, ethylenediamine tetraacetic acid, hydrofluoric acid, and any combination thereof.

Element B10: Wherein the first scale-removal agent and/or the second scale-removal agent is a solvent selected from the group consisting of an aromatic solvent, an organic solvent, a halogenated solvent, and any combination thereof.

Element B11: Wherein the first scale-removal agent and/or the second scale-removal agent is a hydroxide selected from the group consisting of lithium hydroxide, sodium hydroxide, potassium hydroxide, rubidium hydroxide, caesium hydroxide, and any combination thereof.

Element B12: Wherein the first base fluid and/or the second base fluid is selected from the group consisting of an oil-based fluid, an aqueous-based fluid, an aqueous-miscible fluid, a water-in-oil emulsion, an oil-in-water emulsion, and any combination thereof.

By way of non-limiting example, exemplary combinations applicable to B include: B1-B12; B1, B2, and B5; B3 and B6; B4, B7, and B10; B8 and B9; B3, B5, B6, and B8; B11 and B12; B2 and B12; B9, B10, B11, and B12; and the like.

Therefore, the examples and embodiments disclosed herein are well adapted to attain the ends and advantages mentioned as well as those that are inherent therein. The particular examples and embodiments disclosed above are illustrative only, as they may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative examples disclosed above may be altered, combined, or modified and all such variations are considered within the scope and spirit of the present disclosure. The examples and embodiments illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

What is claimed is:

1. A method comprising:

(a) providing a wellbore in a subterranean formation extending from a surface, the wellbore having a total volume and a fluid therein;

wherein the wellbore includes a downhole safety valve (DSV), such that the total volume of the wellbore includes a volume above the DSV and a volume below the DSV, wherein the DSV can be closed or opened, and wherein the DSV is closed;

(b) opening the DSV;

(c) introducing a gas into the wellbore having the DSV opened, thereby displacing the fluid in the wellbore with the gas, such that the gas occupies at least about 50% of the total volume of the wellbore;

(d) closing the DSV;

(e) releasing the gas from the volume of the wellbore above the closed DSV, thereby reducing the pressure above the DSV compared to the pressure below the DSV while the DSV remains closed;

(f) pumping a first treatment fluid comprising a base fluid and a scale-removal agent into the wellbore at a pumping pressure that does not force open the DSV, thereby retaining the first treatment fluid in the volume of the wellbore above the DSV;

(g) terminating pumping;

(h) removing scale from the volume of the wellbore above the DSV with the scale-removal agent in the first treatment fluid;

(i) opening the DSV; and (j) producing the well to remove at least the gas and the first treatment fluid from the wellbore.

2. The method of claim 1, wherein the DSV is operated hydraulically or electrically from surface.

3. The method of claim 1, further comprising repeating (b) through (j) at least once.

4. The method of claim 1, wherein the treatment fluid pumped in (f) has a volume less than the volume of the wellbore above the DSV.

5. The method of claim 1, wherein the wellbore is a low pressure wellbore.

6. The method of claim 1, wherein the gas is selected from the group consisting of natural gas, nitrogen, carbon dioxide, air, a gas-foamed liquid thereof, and any combination thereof.

7. The method of claim 1, wherein the scale-removal agent is selected from the group consisting of a chelating agent, an acid, a solvent, a hydroxide, and any combination thereof.

8. The method of claim 1, wherein the scale-removal agent is a chelating agent selected from the group consisting of methylglycine diacetic acid, (β-alanine diacetic acid, ethylenediaminedisuccinic acid, S,S-ethylenediaminedisuccinic acid, iminodisuccinic acid, hydroxyiminodisuccinic acid, polyamino disuccinic acids, N-bis[2-(1,2-dicarboxyethoxy)ethyl]glycine, N-bis[2-(1,2-dicarboxyethoxy)ethyl] aspartic acid, N-bis[2-(1,2-dicarboxyethoxy)ethyl]methylglycine, N-tris[(1,2-dicarboxyethoxy)ethyl]amine, N-methyliminodiacetic acid, iminodiacetic acid, N-(2-acetamido)iminodiacetic acid, hydroxymethyl-iminodiacetic acid, 2-(2-carboxyethylamino)succinic acid, 2-(2-carboxymethylamino)succinic acid, diethylenetriamine-N,N"-disuccinic acid, triethylenetetramine-N,N'"-disuccinic acid, 1,6-hexamethylenediamine-N,N'-disuccinic acid, tetraethylenepentamine-N,N'"-disuccinic acid, 2-hydroxypropylene-1,3-diamine-N,N'-disuccinic acid, 1,2-propylenediamine-N,N'-disuccinic acid, 1,3-propylenediamine-N,N'-disuccinic acid, cis-cyclohexanediamine-N,N'-disuccinic acid, trans-cyclohexanediamine-N,N'-disuccinic acid, ethylenebis(oxyethylenenitrilo)-N,N'-disuccinic acid, glucoheptanoic acid, cysteic acid-N,N-diacetic acid, cysteic acid-N-monoacetic acid, alanine-N-monoacetic acid, N-(3-hydroxysuccinyl)aspartic acid, N-[2-(3-hydroxysuccinyl)]-L-serine, aspartic acid-N,N-diacetic acid, aspartic acid-N-monoacetic acid, any salt thereof, any derivative thereof, and any combination thereof.

9. The method of claim 1, wherein the scale-removal agent is an acid selected from the group consisting of hydrochloric acid, acetic acid, formic acid, citric acid, glutamic acid, diacetic acid, ethylenediamine tetraacetic acid, hydrofluoric acid, and any combination thereof.

10. The method of claim 1, wherein the scale-removal agent is a solvent selected from the group consisting of an aromatic solvent, an organic solvent, a halogenated solvent, and any combination thereof.

11. The method of claim 1, wherein the scale-removal agent is a hydroxide selected from the group consisting of lithium hydroxide, sodium hydroxide, potassium hydroxide, rubidium hydroxide, caesium hydroxide, and any combination thereof.

12. The method of claim 1, wherein the base fluid is selected from the group consisting of an oil-based fluid, an aqueous-based fluid, an aqueous-miscible fluid, a water-in-oil emulsion, an oil-in-water emulsion, and any combination thereof.

13. A method comprising:

(a) providing a wellbore in a subterranean formation extending from a surface location, the wellbore having a total volume and a fluid therein;

wherein the wellbore includes a downhole safety valve (DSV), such that the total volume of the wellbore includes a volume above the DSV and a volume below the DSV, wherein the DSV can be closed or opened, and wherein the DSV is closed unless a pressure above the DSV exceeds a pressure below the DSV, thereby forcing open the DSV;

(b) opening the DSV;

(c) introducing a gas into the wellbore having the DSV opened, thereby displacing the fluid in the wellbore with the gas, such that the gas occupies at least about 50% of the total volume of the wellbore;

(d) closing the DSV;

(e) releasing the gas from the volume of the wellbore above the closed DSV, thereby reducing the pressure above the DSV compared to the pressure below the DSV while the DSV remains closed;

(f) pumping a first treatment fluid comprising a first base fluid and a first scale-removal agent into the wellbore at a first pumping pressure that does not force open the DSV, thereby retaining the first treatment fluid in the volume of the wellbore above the DSV;

(g) terminating pumping;

(h) removing scale from the volume of the wellbore above the DSV with the first scale-removal agent in the first treatment fluid, thereby causing the scale to dissolve or suspend within the first treatment fluid;

(i) opening the DSV;

(j) introducing a subsequent gas into the wellbore having the DSV opened, thereby displacing the first treatment fluid into the volume of the wellbore below the DSV with the subsequent gas;

(k) closing the DSV;

(l) releasing the subsequent gas from the volume of the wellbore above the closed DSV, thereby reducing the pressure above the DSV compared to the pressure below the DSV while the DSV remains closed;

(m) pumping a subsequent treatment fluid comprising a second base fluid and a second scale-removal agent at a second pumping pressure that does not force open the DSV, thereby retaining the subsequent treatment fluid in the volume of the wellbore above the DSV;

(n) terminating pumping;

(o) removing scale from the volume of the wellbore above the DSV with the second scale-removal agent in the subsequent treatment fluid;

(p) opening the DSV; and (q) producing the well to remove at least the gas, the first treatment fluid, the subsequent gas, and the subsequent treatment fluid from the wellbore.

14. The method of claim 13, wherein the DSV is operated wherein the DSV is operated hydraulically or electrically from surface.

15. The method of claim 13, further comprising repeating (j) through (o) at least once.

16. The method of claim 13, wherein the first treatment fluid pumped in (f) has a volume less than the volume of the wellbore above the DSV.

17. The method of claim 13, wherein the subsequent treatment fluid pumped in (m) has a volume less than the volume of the wellbore above the DSV.

18. The method of claim 13, wherein the wellbore is a low pressure wellbore.

19. The method of claim 13, wherein the gas and the subsequent gas are selected from the group consisting of natural gas, nitrogen, carbon dioxide, air, a gas-foamed liquid thereof, and any combination thereof.

20. The method of claim 13, wherein the first scale-removal agent and the second scale-removal agent are selected from the group consisting of a chelating agent, an acid, a solvent, a hydroxide, and any combination thereof.

* * * * *